US005785583A

United States Patent [19]

Williams, Jr. et al.

[11] Patent Number: 5,785,583

[45] Date of Patent: Jul. 28, 1998

[54] MATERIAL CUTTING ROTOR ASSEMBLY

[75] Inventors: Robert M. Williams, Jr., Ladue; Paul H. Becherer, Festus, both of Mo.

[73] Assignee: Williams Patent Crusher & Pulverizer Company, St. Louis, Mo.

[21] Appl. No.: 814,294

[22] Filed: Mar. 10, 1997

[51] Int. Cl.[6] ..... B24B 7/00; B24B 9/00

[52] U.S. Cl. ..... 451/178; 451/540; 241/243

[58] Field of Search ..... 451/178, 540; 241/235, 236, 242, 243, 295; 83/508.3, 425.4, 499, 501, 502; 125/12, 15

[56] References Cited

U.S. PATENT DOCUMENTS

| | | | |
|---|---|---|---|
| 673,768 | 5/1901 | Fleming | 241/243 |
| 1,477,502 | 12/1923 | Killick | 241/236 |
| 1,679,593 | 8/1928 | Williamson et al. . | |
| 1,980,589 | 11/1934 | Acree | 241/243 |
| 2,143,123 | 1/1939 | Erickson | 241/236 |
| 2,241,491 | 5/1941 | Treloar | 241/243 |
| 3,823,878 | 7/1974 | Ishikura . | |
| 3,899,948 | 8/1975 | Jakob | 83/497 |
| 3,976,252 | 8/1976 | PerDue | 241/243 |
| 4,082,232 | 4/1978 | Brewer . | |
| 4,385,732 | 5/1983 | Williams . | |
| 4,706,899 | 11/1987 | Parker et al. | 241/242 |
| 5,100,069 | 3/1992 | Barclay | 241/295 |
| 5,152,469 | 10/1992 | Dicky | 241/295 |
| 5,395,057 | 3/1995 | Williams, Jr. et al. . | |
| 5,676,321 | 10/1997 | Kroger | 241/236 |

*Primary Examiner*—Timothy V. Eley
*Assistant Examiner*—Derris H. Banks
*Attorney, Agent, or Firm*—Polster, Lieder, Woodruff & Lucchesi, L.C.

[57] ABSTRACT

A material cutting shaft assembly in which a rotary shaft of hexagonal shape in cross section carries an array of material cutting discs between its opposite ends, seat means adjacent the shaft ends, and disc retainer means adjustable and removably mounted in the seat means to hold the array of cutting discs in operative positions to avoid axially directed load stress conditions.

5 Claims, 2 Drawing Sheets

MATERIAL CUTTING ROTOR ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

In shaft mounting an array of rotary cutter discs spaced along a shaft and removably locked on the shaft, the improvement of shaft mounted retainers engaged with the cutter discs to avoid imposing stress in the assembly.

The art of securing an array of rotary cutter disc on a shaft requires retainer devices carried by the shaft at the opposite ends of the shaft carrying the array of cutter discs. The retainers heretofore have been engaged on the shaft in a manner that develops axial stress loads to clamp the array of cutter discs in position to perform the intended material grinding and cutting operations. When discs are damaged or require replacement, the retainer means must be removed before the array of discs can be removed to be able to replace any of the discs. An example of the problem of replacing discs is seen in Williamson et al 1679593 of Aug. 7, 1928. Another example is seen in Williams et al 5395051 of Mar. 7, 1995.

BRIEF SUMMARY OF THE INVENTION

The object of the invention is to avoid developing stress areas in retaining an array of material cutting discs on a shaft so that maximum service life of the discs can be obtained.

Another object is to provide seat surfaces at the opposite ends of a shaft to receive disc retainer means easily assembled in the seat surfaces.

A further object is to provide a hexagonal shaped shaft to carry an array of cutting discs which can be placed on such a shaft in any desired order and to form a disc retainer assembly that is compatible with the hexagonal shaft so as to avoid creating areas of stress in the assembly.

An additional object of the invention is to form at the opposite ends of a rotary shaft carrying an array of material cutting discs retainer means comprising slip-on discs that can be relatively rotatable into positions for exerting holding pressure on the array of cutting discs which avoids creating stress in the shaft when in use.

BRIEF DESCRIPTION OF THE SEVERAL VIEWS OF THE DRAWINGS

A preferred embodiment of the invention is illustrated in the drawings wherein.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptions, variations, alternatives and uses of the invention, including what is presently believed to be the best mode of carrying out the invention, wherein the rotary shaft to support a collection of cutting discs may be typically hexagonal so the cutter discs do not require keys to effect the drive from the shaft.

Figure 1:
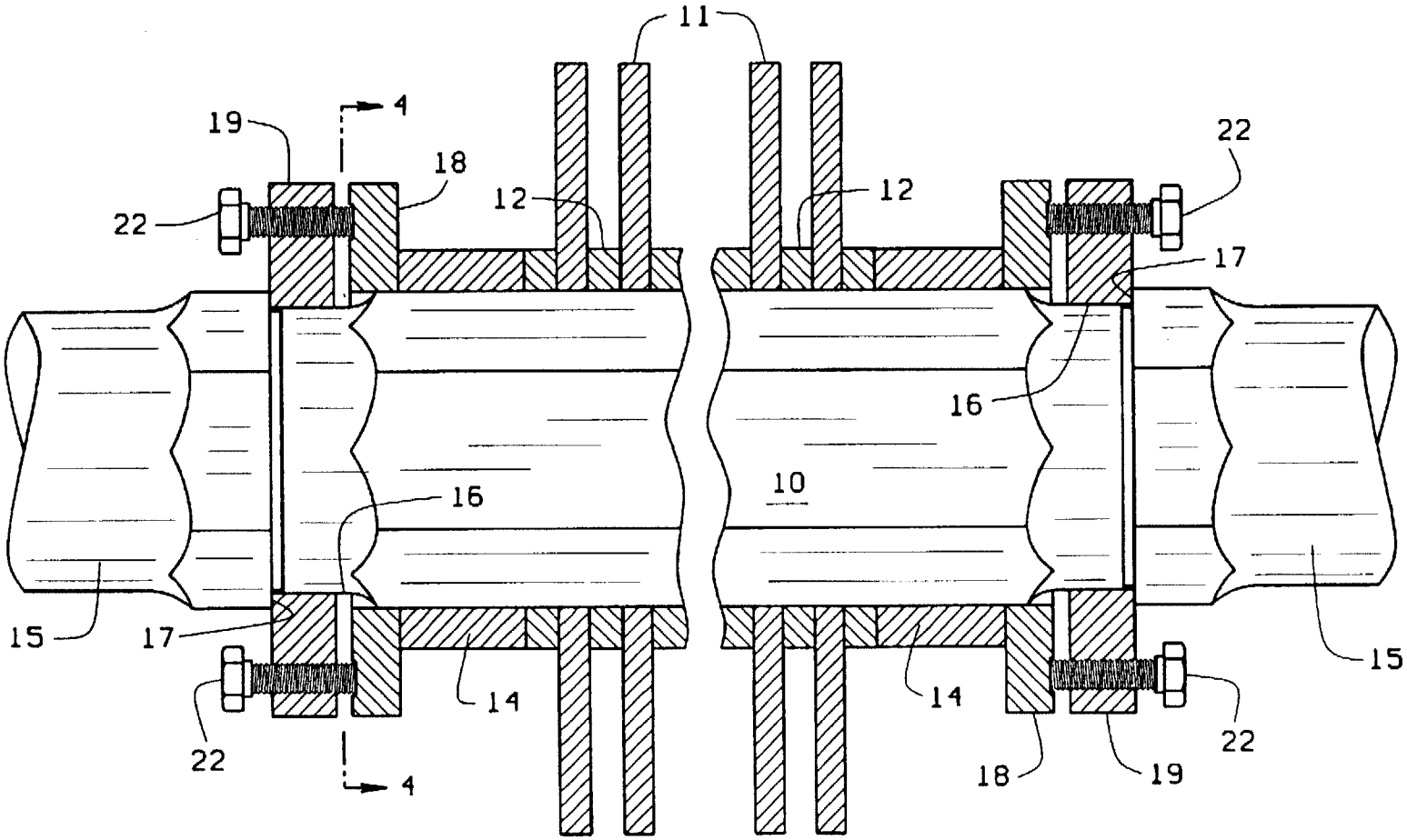
FIG. 1 is an elevation view of a typical elongated hexagonal shaped shaft showing only opposite ends adapted to receive pressure means for holding material cutting discs on the shaft between the opposite ends.

In the view of FIG. 1 there is shown an elongated hexagonal shaft 10 having an array of material cutting discs 11 assembled on the shaft. The discs are separated by suitable rings 12. Each disc is formed with multiple material cutting teeth (not shown) to be spaced around the circumference. The teeth may be arranged in either staggered spacing or they can be in axial alignment along the shaft axis, depending on the type of material to be processed and spacer sleeves 14 are positioned at the ends.

In FIG. 1, the opposite ends 15 of the shaft 10 are machined to provide a suitable cylindrical bearing surface projecting beyond the end of the hexagonal shaping of the shaft surface. Further, inboard of each end 15 there is formed a smooth cylindrical reduction in the diameter of the shaft to form a seat 16 leaving a hexagonal shaped shoulder surface 17 which provides a suitable place to assemble disc retainer means which include a pressure plate 18 and a jack plate 19. The jack plate abuts the shoulder surface 17.

Figure 2:
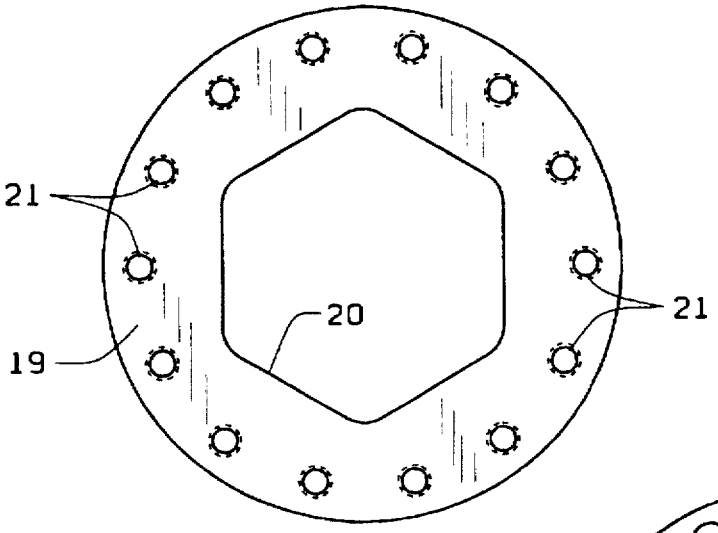
FIG. 2 is a vertical face view of a jack plate having a hexagonal bore and a circumferential spaced set of threaded apertures.

In FIG. 2 there is shown the face of a jack plate 19 which has a hexagonal bore 20 to slide over the shaft 10 and around its face are formed 14 threaded apertures 21 in a circumferential ring. The apertures 21 are located to function as places for receiving the respective jack screws 22 two of which are seen in FIG. 1.

Figure 3:
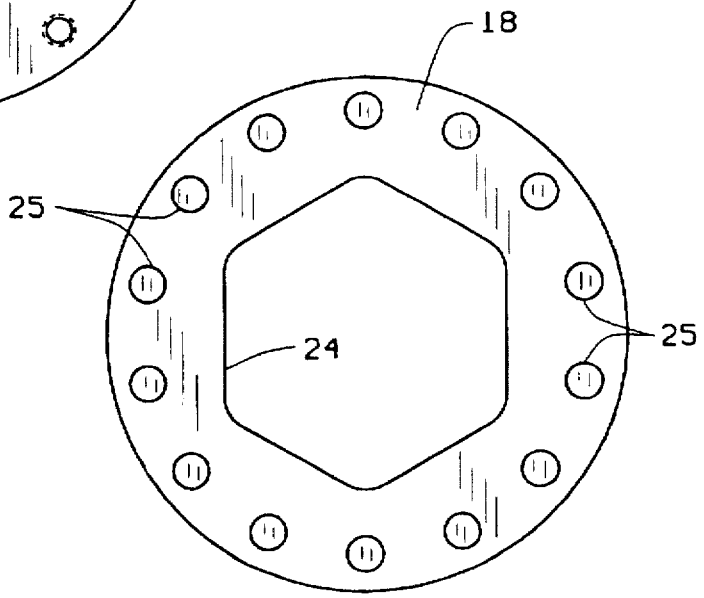
FIG. 3 is a vertical face view of a pressure plate having a circumferential ring of indented seats.

In FIG. 3 there is seen a face of a pressure plate 18 having a hexagonal bore 24, and surrounding that bore is a ring of 14 indented seats 25 to receive the ends of an equal number of jack screws 22, as seen in FIG. 1.

Figure 4:
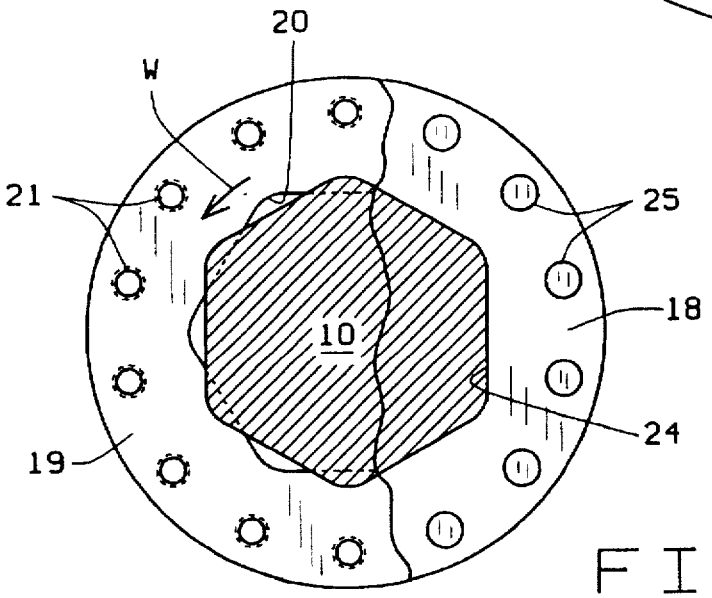
FIG. 4 is a vertical partial section view of the face of the pressure and jack plates in overlying assembled relationship with the jack plate rotated for covering a portion of the pressure plate, that viewing being taken along line A—A in FIG. 1.

In FIG. 4 there is shown a composite view of a jack plate 19 in one half of the view on the left, and on the right one half is a view of the pressure plate 18. These bore surfaces 20 and 24 are aligned to match the hexagonal shaft surfaces so they may be slipped over the shaft ends 15. After the plates are slipped over the shaft ends, the jack plate 19 must be rotated so the apertures 21 are in alignment with certain of the indented seats 25 while the bore 20 is out of registry with bore 24 in the plate 18. The view of FIG. 4 is intended to show at line AA in FIG. 1 the jack plate 19 which has been slipped into the seat 16 and then rotated (see arrow W) so its threaded apertures 21 can be aligned with the seats 25 in the pressure plate 18. Furthermore, the jack plate 19 is placed in abutment with the shoulder 17 of the seat surface 16. Also, the threaded apertures 21 in the jack plate 19 are aligned with the ring of indented seats 25 of the pressure plate 18 to receive the ends of the jack screws 22 (see FIG. 1). In this assembly, the hexagonal bores 20 in the plate 19 are out of registry with the shaft hexagonal configuration In effecting the assembly seen in FIG. 1, the jack screws 22 can be selectively turned up against the pressure plate seats 25, care being taken to be uniform so the pressure is equally passed through the pressure plate 18 and against the sleeve 14 to obtain a uniform pressure through the array of cutter discs 11 and spacer rings 12.

Although a preferred embodiment of the invention has been set forth in the foregoing description and drawings, the invention is recognized to include similar assemblies and modifications to fall within the scope of the improvement.

We claim:

1. A material cutting rotor assembly comprising:

(a) an elongated hexagonally shaped shaft having seat surfaces formed into the hexagonal configurations adjacent opposite ends of said shaft;

(b) material cutter discs having hexagonal bores sized to fit said hexagonally shaped shaft, said discs passing over said seat surfaces;

(c) sleeve means fitted to said shaft ends in position to abut said adjacent cutter discs;

(d) a first disc at each end of said shaft having a hexagonal bore slid over said shaft ends to abut said sleeve means;

(e) a second disc at each end of said shaft having a hexagonal bore slid over said shaft ends to seat in said seat surfaces adjacent said first disc and said second discs are turned to place said hexagonal bores out of alignment with said shaft hexagonal shape; and (f) thrust elements carried by each of said second disc in position to engage on said adjacent first disc and retain said sleeve means in abutment on said adjacent cutter discs.

2. A material cutting rotor assembly comprising:

(a) an elongated hexagonal shaft ending at cylindrical end bearing supported extensions at opposite ends;

(b) a cylindrical seat surface formed at each end of said hexagonal shaft to provide an annular shoulder formed on said shaft in said seat surface;

(c) a series of material cutting discs having internal hexagonal bores to fit onto said elongated hexagonal shaft;

(d) spacer sleeves fitted over the ends of said elongated hexagonal shaft adjacent said seat surfaces;

(e) a first plate formed with a hexagonal bore fitted over said opposite shaft ends to engage said spacer sleeve and having an axial thickness to allow for a surface on each first plate to extend into said seat surfaces;

(f) a second plate formed with a hexagonal bore fitted over said opposite ends of said shaft, said second plate being rotatable in said seat surface to be rotated relative to said first plate and being retained against said annular shoulder in said seat surface; and (g) threaded thrust elements threaded through said second plate to advance against said first plate to retain said cutter disc on said hexagonal shaft.

3. The material cutting rotor assembly set forth in claim 2 wherein each of said first discs is formed with shallow indentations, and said thrust elements carried in each of said second discs are adapted to seat in said shallow indentations of said first discs.

4. The material cutting rotor assembly set forth in claim 2 wherein said second discs seated in said seat surfaces at the opposite ends of said shaft are rotated to place said hexagonal bore out of alignment with said shaft hexagonal shape.

5. In a rotary hexagonal shaft having a series of material cutting discs fitted on the hexagonal shaft and locking mean on the rotary shaft at its opposite ends, the improvement comprising:

a) the formation on the opposite ends of the hexagonal shaft cylindrical surfaces having a hexagonal shoulder spaced from the cutting disc;

b) means for locking the cutting discs on the hexagonal shaft including first discs having a hexagonal bore fitted over the shaft ends to abut on the cutting discs adjacent said cylindrical surfaces on the shaft; and second discs having hexagonal bores fitted over the shaft ends to be free to rotate on the shaft in said cylindrical surface between said first discs on said hexagonal shoulder such that the hexagonal bores are out of registry with the hexagonal shape of the shaft; and c) thrust elements on said second discs to project through said second discs and press against said first discs to move said second disc against said hexagonal shoulder.

* * * * *